US012780478B2

(12) United States Patent
Bylin

(10) Patent No.: US 12,780,478 B2
(45) Date of Patent: Nov. 3, 2026

(54) MODULAR PACKAGING SYSTEM FOR PACKAGING OF MEDICAL ARTICLES AND MODULES FOR A MODULAR PACKAGING SYSTEM FOR MEDICAL ARTICLES

(71) Applicant: GRANITEN ENGINEERING AB, Uddevalla (SE)

(72) Inventor: Johan Bylin, Vänersborg (SE)

(73) Assignee: GRANITEN ENGINEERING AB, Uddevalla (SE)

( * ) Notice: Subject to any disclaimer, the term of this patent is extended or adjusted under 35 U.S.C. 154(b) by 0 days.

(21) Appl. No.: 18/880,090

(22) PCT Filed: Jun. 28, 2023

(86) PCT No.: PCT/SE2023/050668
§ 371 (c)(1),
(2) Date: Dec. 30, 2024

(87) PCT Pub. No.: WO2024/010510
PCT Pub. Date: Jan. 11, 2024

(65) Prior Publication Data

US 2026/0001673 A1 Jan. 1, 2026

(30) Foreign Application Priority Data

Jul. 5, 2022 (SE) ..... 2250847-7

(51) Int. Cl.
*B65B 59/04* (2006.01)
*B65B 57/00* (2006.01)
*B65B 65/00* (2006.01)

(52) U.S. Cl.
CPC ..... *B65B 59/04* (2013.01); *B65B 57/00* (2013.01); *B65B 65/003* (2013.01)

(58) Field of Classification Search
CPC ..... B65B 59/04; B65B 57/00; B65B 65/003
See application file for complete search history.

(56) References Cited

U.S. PATENT DOCUMENTS 7,492,973 B2 * 2/2009 Cato ..... G06K 7/10861 382/312
9,011,771 B2 * 4/2015 Hagen ..... B01L 9/52 436/526

(Continued)

FOREIGN PATENT DOCUMENTS

CN 108750521 A * 11/2018 ..... B65G 1/0407
EP 3354581 A1 * 8/2018 ..... G06Q 10/087

(Continued)

*Primary Examiner* — Lucas E. A. Palmer
(74) *Attorney, Agent, or Firm* — DUANE MORRIS LLP; Gregory M. Lefkowitz; Daniel J. Tarr

(57) ABSTRACT

A main module (110) for a modular packaging system for packaging of medical articles, wherein the main module (100) comprises a main control unit (mCU), a mounting backbone structure (111) configured to receive a plurality of sub-modules (**120_1-120_*n*), a plurality of main-module communication interfaces (I_1***m*-I_nm), each associated with a specific order position of a sub-module, and wherein the main control unit (mCU) is configured to receive a sub-module identification via the main-module communication interfaces (I_1*m*-I_nm), and the sub-module identification at least gives access to at least one dimensional parameter of a sub-module (**120_1-120_*n***).

14 Claims, 4 Drawing Sheets

(56) References Cited

U.S. PATENT DOCUMENTS

| | | | | |
|---|---|---|---|---|
| 9,604,795 | B2 * | 3/2017 | Aumann | B65G 54/02 |
| 10,974,914 | B2 * | 4/2021 | Kleinikkink | B65G 35/08 |
| 11,273,944 | B2 * | 3/2022 | Pickett | B65G 54/02 |
| 11,884,493 | B1 * | 1/2024 | Dwivedi | B60L 1/00 |
| 2006/0090109 | A1 * | 4/2006 | Bonnet | G06F 13/409 714/724 |
| 2008/0152756 | A1 * | 6/2008 | Ream | A23G 3/0097 53/493 |
| 2013/0243561 | A1 * | 9/2013 | Holmes | G07F 11/44 700/214 |
| 2014/0244026 | A1 * | 8/2014 | Neiser | B65G 1/1378 700/216 |
| 2016/0056043 | A1 * | 2/2016 | Tanaka | H10D 86/60 438/585 |
| 2016/0194158 | A1 * | 7/2016 | Senn | B08B 1/34 198/794 |
| 2018/0215485 | A1 | 8/2018 | Zeilstra et al. | |
| 2018/0251251 | A1 * | 9/2018 | Wittmann | B65B 21/245 |
| 2019/0359359 | A1 * | 11/2019 | Scalerandi | B65G 47/5127 |
| 2023/0271738 | A1 * | 8/2023 | Neubauer | B65C 9/045 156/391 |
| 2025/0008929 | A1 * | 1/2025 | Shah | G05D 1/0214 |
| 2025/0033862 | A1 * | 1/2025 | Guissart | G07F 11/00 |
| 2025/0100733 | A1 * | 3/2025 | Meyhofer | B65B 25/001 |
| 2025/0214727 | A1 * | 7/2025 | Santos Vale | B65G 47/20 |

FOREIGN PATENT DOCUMENTS

| | | | | |
|---|---|---|---|---|
| EP | 3653541 | | 5/2020 | |
| EP | 4151571 | B1 * | 11/2024 | H02K 41/031 |
| SE | 2250847 | A1 * | 1/2024 | G05B 19/0426 |
| WO | WO-2006032874 | A1 * | 3/2006 | B65B 65/003 |
| WO | WO-2017167421 | A1 * | 10/2017 | B65B 65/003 |
| WO | WO-2022090429 | A1 * | 5/2022 | B31B 50/006 |
| WO | WO-2022219292 | A1 * | 10/2022 | B65B 65/003 |
| WO | WO-2025008734 | A2 * | 1/2025 | B29C 66/53461 |

* cited by examiner

MODULAR PACKAGING SYSTEM FOR PACKAGING OF MEDICAL ARTICLES AND MODULES FOR A MODULAR PACKAGING SYSTEM FOR MEDICAL ARTICLES

CROSS-REFERENCE TO RELATED APPLICATIONS

This application is a § 371 national stage entry of International Application No. PCT/SE2023/050668, filed Jun. 28, 2023, which claims priority to Sweden Patent Application No. 2250847-7, filed Jul. 5, 2022, the entire contents of which are incorporated herein by reference.

TECHNICAL FIELD

The present invention relates generally to the field of packaging machines for packaging of medical articles and especially to modular packaging systems for packaging of medical articles.

BACKGROUND

Standard today is large scale packaging machines, designed for high speeds to produce high volumes packages of standardized medical articles and/or medicine. These machines are highly specialized with unique components for each article produced by the machine. This enables the machines to be driven at high speeds and producing high volumes in short times. A drawback with these machines is that they require long changeover times, in which the machine stands still and is unproductive.

This becomes an increasing drawback as the trend in the medical industry goes towards smaller batches and more individual tailored medicines, where the number of produced articles in extreme cases is only one single article.

Hence, the packaging machines of today is not adapted to the fast change over times needed, when the batch sizes decrease, due to their long change over time.

SUMMARY

A first object of the present disclosure is to suggest a main module for a modular packaging system for medical articles. A second object of the present disclosure is to suggest a sub-module for a modular packaging system for medical articles. A third object of the present disclosure is to suggest a modular packaging system for medical articles. A fourth object of this disclosure is to suggest a method for positioning a sub-module in relation to main-module in a modular packaging system for medical articles.

A modular packaging system for medical articles in this disclosure comprises of two main components, namely main-module and sub-module. The main-module possesses the main control of the packaging process, and the sub-modules are attached there to and perform their tasks individually. The sub-modules can be controlled by the main-module or possess different degrees of individual self-control.

The main purpose with a modular packaging system for medical articles is to enable short changeover times, i.e. when the packaging system changes between packaging of different articles. This is enabled, through that the individual sub-modules can be exchanges to adapt the packaging system to the different functions needed, dependent on the article to be produced at the time.

To enable to control and coordinate the flow through the whole packaging system it is essential to know the order position of each sub-module in relation to the main-module.

A first object of this disclosure is achieved by a main module for a modular packaging system for packaging of medical articles, wherein the main module comprises, a main control unit, a mounting backbone structure configured to receive a plurality of sub-modules, a plurality of main-module communication interfaces, each main-module communication interface associated with a specific order position of a respective sub-module received on the mounting backbone structure, and wherein the main control unit is configured to receive a sub-module identification via the main-module communication interfaces, and the sub-module identification at least gives access to at least one dimensional parameter of a respective sub-module.

The main control unit is a CPU controlling all the functions of the main module and controls the communication with the sub-modules attached thereto. The main control unit can be locally provided, be distributed or be a cloud-based CPU. The received at least one sub-module identification, and the at least one dimensional parameter, may be stored in a storage unit.

The mounting backbone structure is a hardware component which any sub-modules are seated and attached. The mounting backbone structure defines a coordinate system in which the specific position of the individual sub-modules can be positioned. The coordinate system of the mounting backbone structure can be one dimensional, two dimensional or three dimensional, i.e., it can facilitate a seating of sub-modules in one direction out from the main-module, two directions out from the main-module, or three directions out from the main module.

The main-module communication interface is a communication interface to the sub-module and is associated with a specific order position of a respective sub-module connected thereto. Non-limiting examples of a main-module communication interface are, one or a combination of near field communication, ethernet, wifi, Bluetooth, a bit pattern or any other type of suitable connection, as long as it can detect a corresponding sub-module communication interface connected thereto. The communication interfaces can even be one-directional, such as a QR- or bar-code, or text and/or numbers on the sub-module side and a corresponding reader on the main-module side.

The sub-module identification give access to the at least one dimensional parameter. The dimensional parameter can be part of the identification or even the only sub-module identification, or in that the main control unit can access individual sub-modules dimensional parameters associated with the received sub-module identification number.

The effect of the disclosed main-module is that independent of the number of sub-modules that are attached to the main-module, both the order position in relation to the main-module of each sub-module connected thereto and the exact position of each sub-module on the mounting backbone structure can be determined.

The order position defines the order of the respective sub-module counted from the main module.

The exact position defines the distance (in at least direction (X, Y, Z)) of the respective sub-module counted from the main module.

The main control unit, knowns at which main-module communication interface each sub-module is connected to and each main-module communication interface is associated with a specific order position. Hence, the main control unit knows the specific order position of each connected sub-module. Furthermore, as the main control unit receives a sub-module identification, it gains access to at least one dimensional parameter of a respective sub-module arranged on the mounting backbone structure. The main control unit can thereby determine the exact position of a specific sub-module-in the coordinate system defined by the mounting backbone structure-by adding the dimensional parameters from respective sub-modules arranged on the mounting backbone structure having a lower specific order position.

The number of dimension parameters that is communicated is equal to the number of dimensions of the mounting backbone structure. Whereby the position of each of the sub-module that is connected to the main-module can be determined.

In one exemplary main-module the at least one dimensional parameter at least comprises one of the width, height and depth of the respective sub-module. Which and which combination of dimensional parameters that is communicated is dependent on the number of dimensions of the mounting backbone structure.

In one exemplary main-module the mounting backbone structure is provided with means for positioning a sub-module in an exact position on the mounting backbone structure. Non-limiting examples of means for positioning a sub-module are one or a combination of protrusion, groove hole pattern or the like, which is provided with a specific distance to the main-module. One exemplary effect thereof is that it facilitates an easy and exact positioning of any sub-module on to the mounting backbone structure and thereby exact distance in one or several dimensions to the sub-module.

In one exemplary main-module, the main module comprises a transport system, configured to transport a packaging substrate to the sub-modules. Due to the exact positioning of the sub-modules, packages and packaging substrates can be transported between the different modules with high precision in positioning due to the means for positioning provided on the mounting backbone structure and the known specific order position and position of the sub-modules.

A second object of this disclosure is achieved by a sub-module for a modular packaging system for packaging of medical articles, wherein the sub-module is configured to be received upon a mounting backbone structure of a main module of a modular packaging system, and wherein the sub-module comprises at least one machine part, for performing at least one function in a modular packaging system, a seat for positioning the sub-module upon a mounting backbone structure of a main-module, and a sub-module communication interface for communicating with a main module, and at least configured to communicate a sub-module identification via a plurality of main-module communication interfaces arranged on the main module, and the sub-module identification at least gives access to at least one dimensional parameter of the sub-module.

The main module to which the sub-module is to be received upon may be any main module as disclosed herein. The modular packaging system for packaging articles may be any modular packaging system as disclosed herein.

The effect of the disclosed sub-module is that a main module control unit, can determine its specific order position in relation to the main module it is connected to and the exact position of sub-module on the mounting backbone structure it is received upon. This is achieved through the combination of the knowledge of which main-module communication interface the sub-module is connected to and the access to at least one dimension of the sub-module.

A sub-module is configured to perform a packaging function in the modular packaging system. A function can e.g., be picking up a packaging substrate, cap or bottle, folding e.g., a packaging substrate, filling e.g., a bottle, package or syringe, tightening e.g., a cap on a bottle.

One exemplary sub-module comprises a sub-module control unit, configured to be in communication connection with a main-module control unit. By providing the sub-module with a sub-module control unit, the sub-module can support the main-module control unit, or control the sub-module independently, whereby the flexibility of the sub-module increases.

In one exemplary sub-module the at least one dimensional parameter at least comprises one of the width, height, and depth of the sub-module.

In one exemplary sub-module the seat is configured for positioning the sub-module in an exact position on a mounting backbone structure of a main module by interacting with means for positioning the sub-module provided on a mounting backbone structure of a main module.

In one exemplary sub-module, the sub-module comprises a fastening structure configured to fixating the sub-module upon a mounting backbone structure of a main-module. Non-limiting examples of a fastening structure are one or a combination of screws, bolts, clips, nuts, rivets, anchors, straps, or pins.

A third object of this disclosure is achieved through a modular packaging system for packaging of medical articles, comprising a main module and at least one sub-module, wherein the main module comprises a main control unit, a mounting backbone structure configured to receive a plurality of sub-modules, a plurality of main-module communication interfaces, each associated with a specific order position of a sub-module, and wherein the at least one sub-module comprises at least one machine part (e.g., robot) for performing at least one function in the modular packaging system, a seat for positioning the sub-module upon the mounting backbone structure of the main-module, a sub-module communication interface for communicating with the main module, and at least configured to communicate a sub-module identification via the main-module communication interfaces, and the sub-module identification at least gives access to at least one dimensional parameter of a respective sub-module, and wherein at least one sub-module seat is seated upon the mounting backbone structure of the main module, and wherein the sub-module communication interfaces and the main-module communication interfaces are connected to one another and the main control unit is configured to receive the sub-module identification via the main-module communication interfaces, and the sub-module identification at least gives access to at least one dimensional parameter of a respective sub-module, via the main-module communication interfaces.

The main module and the at least one sub-module may be any main module or any sub-module as disclosed herein.

The effect of the disclosed modular packaging system for packaging medical articles, is a flexible system allowing the main modules control unit in an easy manner to know the specific order position of each sub-module connected to the modular packaging system and the exact position of each sub-module on the mounting backbone structure. This is achieved through the order position dedicated communication interfaces of the main module, in combination with the access to the dimension parameters of the sub-module and exact positioning on the mounting backbone structure.

One exemplary modular packaging system further comprises a transportation system configured to transport a packaging substrate between the main module and the at least one sub-module.

A fourth object of this disclosure is achieved by a method for positioning a sub-module in relation to a main module in a modular packaging system, wherein the method:

- detecting a first sub-module through a the first positioned main-module communication interface,
- detecting a sub-module identification of the first sub-module,
- accessing at least one dimensional parameter of the first sub-module, and
- positioning the first sub-module in relation to the main module.

The method allows a precise positioning of each sub-module attached to the main module.

In one exemplary method, the method further comprises:

- detecting a second sub-module through the second positioned main-module communication interface,
- detecting a sub-module identification, from the second sub-module,
- accessing at least one dimensional parameter of the second sub-module, and
- positioning the second sub-module in relation to the main module based on the one dimensional parameter of the second sub-module and the position of the first sub-module.

In one exemplary method, the sub-module, the main module and the modular packaging system are any sub-module, main module and modular packaging system as disclosed herein.

BRIEF DESCRIPTION OF THE DRAWINGS

The invention is now described, by way of example, with reference to the accompanying figures, in which.

DETAILED DESCRIPTION

The detailed description with reference to the disclosed embodiments are to be viewed as examples that combining specific features described above. It is to be understood that additional examples may be achieved by combining other and/or fewer/more features than in the disclosed embodiments. Hence, the figures disclose exemplary embodiments and not as exclusive combinations. In this context is should also be noted that, for the sake of simplicity, all figures are schematically disclosed, as long as nothing else is said.

Figure 1:
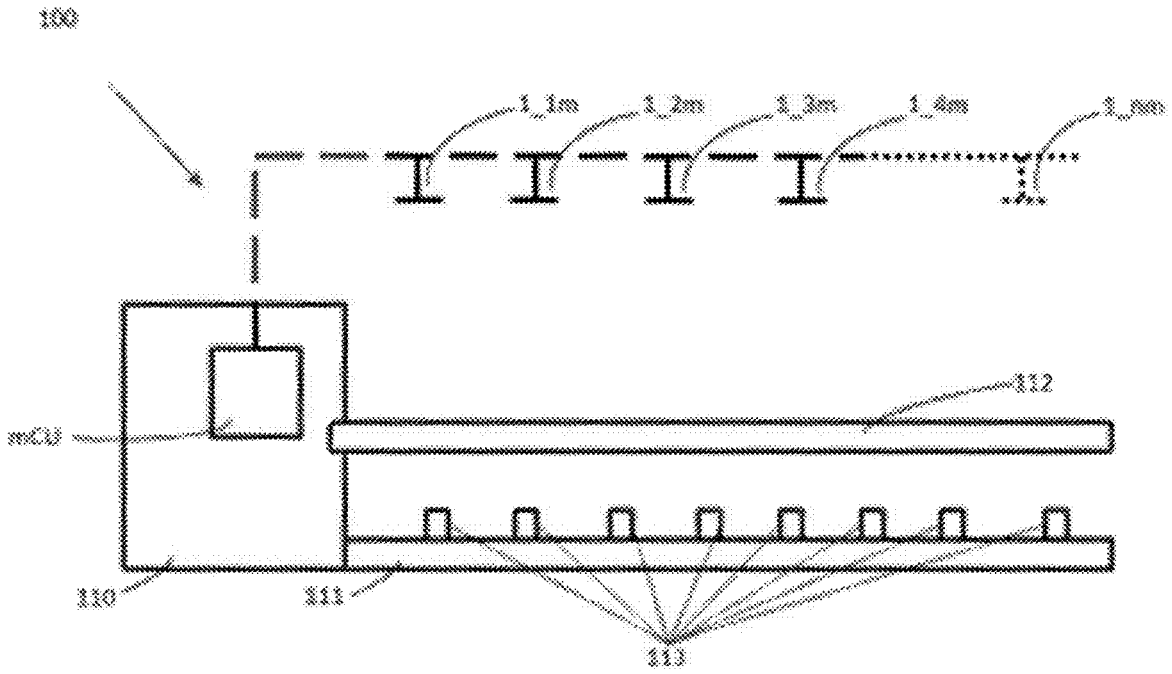
FIG. 1 illustrates a schematic representation of a main module for a modular packaging system of medical articles in accordance with an exemplary embodiment.

FIG. 1 shows a schematic representation of a main module 110 for a modular packaging system of medical articles as disclosed herein. The main module 110 comprises a main control unit mCU arranged within the main module 110, and further comprises a mounting backbone structure 111. The main control unit mCU is a CPU controlling all the function of the main module. Further, the main control unit mCU is configured to receive a sub-module identification via a plurality of main-module communication interfaces I_1*m*-I_nm. When sub-modules are arranged on the mounting backbone structure 111, each main-module communication interface I_1*m*-I_nm is associated with a specific order position of a sub-module. The sub-module identification at least gives access to at least one dimensional parameter of a sub-module.

As previously described, the dimensional parameter of the sub-module may be one of the width, height and depth of the respective sub-module associated with the corresponding main-module communication interface I_1*m*-I_nm.

The mounting backbone structure 111 is in the example illustrated in FIG. 1 arranged at a bottom of the main module 110. The mounting backbone structure 111 is configured to receive a plurality of sub-modules arranged to perform specific functions. As can be seen in FIG. 1, the mounting backbone 111 further comprises means 113 for positioning a sub-module in an exact position on the backbone structure 111. In the example illustrated in FIG. 1, the means 113 are protrusions arranged with a specific distance between each other.

The exemplary main module 110 illustrated in FIG. 1 further comprises a transport system 112 configured to transport a package or packaging substrate to respective sub-module when the sub-modules are arranged on the mounting backbone structure 111. The transport system 112 may be any conventional transport system within the packaging industry, such as a conveyor system, individual controlled holders, or e.g., robotic arms 112. However, the skilled person understands that other transport systems may be utilized as well.

Figure 2:
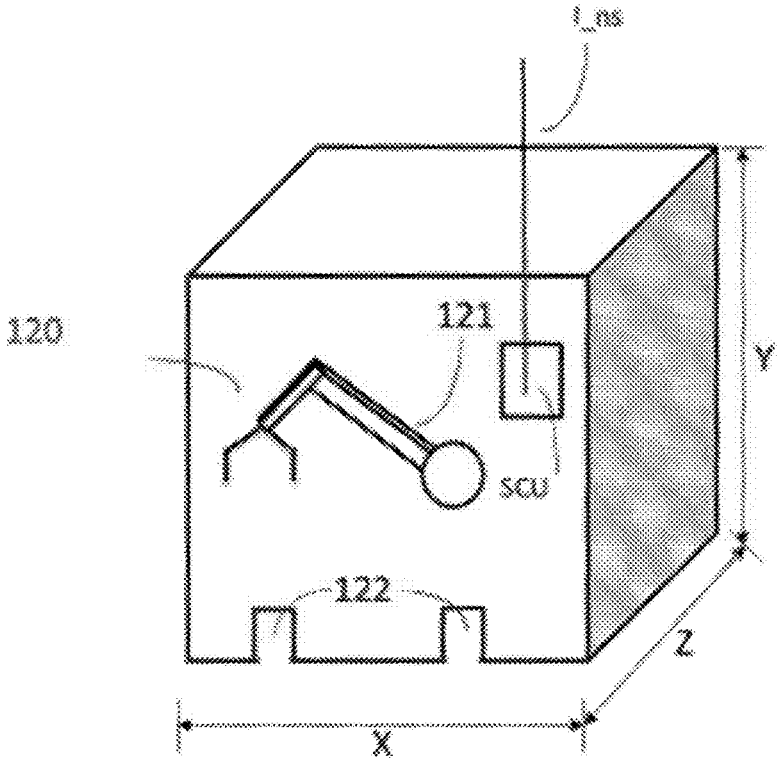
FIG. 2 illustrates a schematic representation of a sub-module for a modular packaging system for packaging of medical articles in accordance with an exemplary embodiment.

FIG. 2 illustrates a schematic representation of a sub-module 120 for a modular packaging system for packaging of medical articles as disclosed herein. The sub-module 120 extends in three dimensions X, Y, Z. In FIG. 2, X represents the width of the sub-module 120, Y represents the height of the sub-module 120, and Z represents the depth of the sub-module 120.

The sub-module 120 is configured to be received upon a mounting backbone structure 111 of a main module as disclosed herein. The sub-module 120 further comprises machine parts 121. In the example illustrated in FIG. 2, the sub-module 120 comprises one machine part 121, more specifically a robot arm for performing a function. As previously described, the function can e.g., be picking up a packaging substrate, cap or bottle, folding e.g., a packaging substrate, filling e.g., a bottle, package or syringe, tightening e.g., a cap on a bottle.

In the example illustrated in FIG. 2, the sub-module 120 comprises two seats 122 for positioning the sub-module 120 upon a mounting backbone structure of a main-module as disclosed herein. The seats 122 may engage with corresponding means for positioning of the sub-module 120 in an exact position on the mounting backbone structure of a main-module as disclosed herein.

The sub-module illustrated in FIG. 2 further comprises a sub-module control unit SCU. Arranged in connection to the sub-module control unit SCU is a sub-module communication interface I_ns for communication with a main module. The sub-module communication interface I_ns is further at least configured to communicate an identification of the sub-module 120 via a main module-communication interface as disclosed herein. The sub-module identification at least gives access to at least one dimensional parameter of a sub-module.

Figure 3:
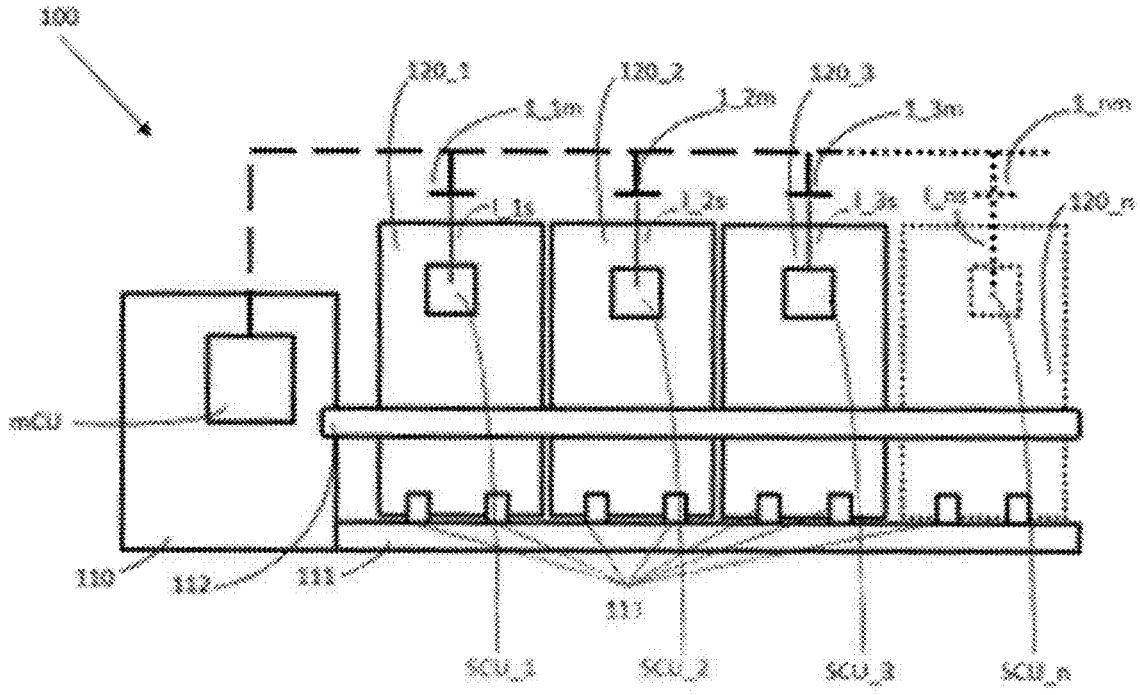
FIG. 3 illustrates a schematic representation of a modular packaging system for packaging of medical articles comprising a main module and at least one sub-module in accordance with an exemplary embodiment.

FIG. 3 illustrates a schematic representation of a modular packaging system 100 for packaging medical articles comprising a main module and at least one sub-module as disclosed herein. The modular packaging system 100 comprises a main module 110 and at least one sub-module 120_1, 120_2, 120_3, **120_*n*. As previously described, the main module 110 comprises a main control unit mCU, a mounting backbone structure 111 configured to receive at least one sub-module 120_1, 120_2, 120_3, 120_*n*. Each received sub-module 120_1, 120_2, 120_3, 120_*n* is arranged on the mounting backbone structure 111 by means 113 for positioning the sub-modules 120_1, 120_2, 120_3, 120_*n* in an exact position on the mounting backbone structure 111**.

The at least one sub-module 120_1, 120_2, 120_3, **120_*n* comprises machine parts (not illustrated in FIG. 3) for performing at least one function in the modular packaging system. Further, the at least one sub-module 120_1, 120_2, 120_3, 120_*n* comprises a seat for positioning the sub-module upon a backbone structure 111 of the main-module (not illustrated in FIG. 3**).

As can be seen in FIG. 3, each sub-module 120_1, 120_2, 120_3, **120_*n* comprises a sub-module communication interface I_1***s*, I_2*s*, I_3*s*, I_ns for communicating with the main module 110. Each sub-module communication interface I_1*s*, I_2*s*, I_3*s*, I_ns is connected to a corresponding main-module communication interface I_1*m*, I_2*m*, I_3*m*, I_nm. This allows the communication of an identification of each sub-module 120_1, 120_2, 120_3, **120_*n* arranged in connection with a corresponding sub-module communication interface I_1***s*, I_2*s*, I_3*s*, I_ns. The identification gives at least access to at least one dimensional parameter of a sub-module 120_1, 120_2, 120_3, **120_*n*. The at least dimensional parameter is then received by the main control unit mCU of the main module 110**.

The modular packaging system 100 illustrated in FIG. 3 further comprises a transport system 112 configured to transport a packaging substrate to respective sub-modules when the sub-modules are arranged on the main module.

Figure 4:
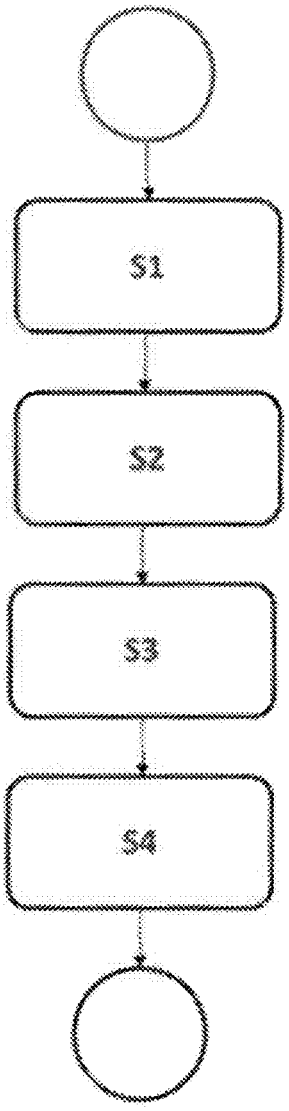
FIG. 4 shows a flowchart of a method according to a method for positioning a sub-module in accordance with an exemplary embodiment.

FIG. 4 shows a flowchart of a method according to a method for positioning a sub-module as disclosed herein. The method comprises detecting S1 g a first sub-module through a the first positioned main-module communication interface. The method further comprises detecting S2 a sub-module identification from the first sub-module. The sub-module identification may be according to any of the previous disclosed embodiments. The method further comprises accessing S3 at least one dimensional parameter of the first sub-module, and positioning S4 the first sub-module in relation to the main module.

The invention claimed is:

1. A main module for a modular packaging system for packaging of medical articles, wherein the main module comprises:

a main control unit, a mounting backbone structure configured to receive a plurality of sub-modules, a plurality of main-module communication interfaces, each associated with a specific order position of a respective sub-module received on the mounting backbone structure, the main control unit is configured to receive a sub-module identification via the main-module communication interfaces, and the sub-module identification at least gives access to at least one dimensional parameter (X, Y, Z) of a respective sub-module.

2. The main module according to claim 1, wherein the at least one dimensional parameter (X, Y, Z) at least comprises one of the width (X), height (Y) and depth (Z) of the respective sub-module.

3. The main module according to claim 1, wherein the mounting backbone structure is provided with means for positioning a sub-module in an exact position on the mounting backbone structure.

4. The main-module according to claim 1, wherein the main module comprises a transport system, wherein the transport system is configured to transport a packaging substrate to the sub-modules.

5. A sub-module for a modular packaging system for packaging of medical articles, wherein the sub-module is configured to be received upon a mounting backbone structure of a main module of a modular packaging system, and wherein the sub-module comprises:

at least one machine part for performing at least one function in a modular packaging system, a seat for positioning the sub-module upon a mounting backbone structure of a main-module, a sub-module communication interface for communicating with a main module, and at least configured to communicate a sub-module identification via a plurality of main-module communication interfaces arranged on a main module, and the sub-module identification at least gives access to at least one dimensional parameter (X, Y, Z) of the sub-module.

6. The sub-module (**120_1-120_*n*) according to claim 5, wherein the sub-module (120_1-120_*n*) comprises a sub-module control unit (SCU_1**-SCU_*n*), configured to be in communication connection with a main-module control unit (mCU).

7. The sub-module according to claim 5, wherein the at least one dimensional parameter (X, Y, Z) at least comprises one of the width (X), height (Y) and depth (Z) of the sub-module.

8. The sub-module according to claim 5, wherein the seat is configured for positioning the sub-module in an exact position on a mounting backbone structure of a main module by interacting with means for positioning the sub-module provided on a mounting backbone structure of a main module.

9. The sub-module according to claim 5, wherein the sub-module comprises a fastening structure configured to fixating the sub-module upon a mounting backbone structure of a main-module.

10. A modular packaging system for packaging of medical articles, comprising a main module and at least one sub-module, wherein the main module comprises:

a main control unit, a mounting backbone structure configured to receive a plurality of sub-modules, a plurality of main-module communication interfaces, each associated with a specific order position of a respective sub-module received on the mounting backbone structure, and wherein the at least one sub-module comprises:

at least one machine part for performing at least one function in the modular packaging system, a seat for positioning the sub-module upon the mounting backbone structure of the main-module, a sub-module communication interface for communicating with the main module, and at least configured to communicate a sub-module identification via the main-module communication interfaces, and the sub-module identification at least gives access to at least one dimensional parameter of a respective sub-module, and wherein at least one sub-module seat is seated upon the mounting backbone structure of the main module, and wherein the sub-module communication interfaces and the main-module communication interfaces are connected to one another and the main control unit is configured to receive the sub-module identification via the main-module communication interfaces, and the sub-module identification at least gives access to at least one dimensional parameter of a respective sub-module, via the main-module communication interfaces.

11. The modular packaging system according to claim 10, wherein the modular packaging system further comprises a transportation system configured to transport a packaging substrate between the main module and the at least one sub-module.

12. A method for positioning a sub-module in relation to a main module in a modular packaging system, wherein the method comprises:

detecting a first sub-module through a first positioned main-module communication interface, detecting a sub-module identification, from the first sub-module, accessing at least one dimensional parameter of the first sub-module, and positioning the first sub-module in relation to the main module.

13. The according to claim 12, wherein the method further comprises:

detecting a second sub-module through the second positioned main-module communication interface, detecting a sub-module identification, from the second sub-module, accessing at least one dimensional parameter of the second sub-module, and positioning the second sub-module in relation to the main module based on the one dimensional parameter of the second sub-module and the position of the first sub-module.

14. The method according to claim 12, wherein the modular packaging system comprises:

a main control unit, a mounting backbone structure configured to receive a plurality of sub-modules, a plurality of main-module communication interfaces, each associated with a specific order position of a respective sub-module received on the mounting backbone structure;

and wherein the at least one sub-module comprises:

at least one machine part for performing at least one function in the modular packaging system, a seat for positioning the sub-module upon the mounting backbone structure of the main-module, a sub-module communication interface for communicating with the main module, and at least configured to communicate a sub-module identification via the main-module communication interfaces arranged on a main module, and the sub-module identification at least gives access to at least one dimensional parameter (X, Y, Z) of the sub-module, and the sub-module identification at least gives access to at least one dimensional parameter of a respective sub-module, and wherein at least one sub-module seat is seated upon the mounting backbone structure of the main module, and wherein the sub-module communication interfaces and the main-module communication interfaces are connected to one another and the main control unit is configured to receive the sub-module identification via the main-module communication interfaces, and the sub-module identification at least gives access to at least one dimensional parameter of a respective sub-module, via the main-module communication interfaces.

* * * * *